US010395806B2

(12) United States Patent
Inoue et al.

(10) Patent No.: US 10,395,806 B2
(45) Date of Patent: Aug. 27, 2019

(54) GRAIN-ORIENTED ELECTRICAL STEEL SHEET AND METHOD OF MANUFACTURING THE SAME

(71) Applicant: JFE Steel Corporation, Tokyo (JP)

(72) Inventors: Hirotaka Inoue, Tokyo (JP); Shigehiro Takajo, Tokyo (JP); Hiroi Yamaguchi, Tokyo (JP); Seiji Okabe, Tokyo (JP); Kazuhiro Hanazawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 1303 days.

(21) Appl. No.: 14/369,237

(22) PCT Filed: Dec. 27, 2012

(86) PCT No.: PCT/JP2012/008408
§ 371 (c)(1),
(2) Date: Jun. 27, 2014

(87) PCT Pub. No.: WO2013/099272
PCT Pub. Date: Jul. 4, 2013

(65) Prior Publication Data

US 2014/0360629 A1 Dec. 11, 2014

(30) Foreign Application Priority Data

Dec. 28, 2011 (JP) ..... 2011-289844

(51) Int. Cl.
*H01F 1/147* (2006.01)
*C21D 8/12* (2006.01)
(Continued)

(52) U.S. Cl.
CPC ..... *H01F 1/14775* (2013.01); *C21D 1/38* (2013.01); *C21D 8/12* (2013.01); *C21D 8/1255* (2013.01);
(Continued)

(58) Field of Classification Search
CPC ..... C21D 8/12; H01F 27/245; H01F 1/14775
(Continued)

(56) References Cited

U.S. PATENT DOCUMENTS 6,280,862 B1 8/2001 Inokuti
2002/0011278 A1 1/2002 Komatsubara et al.
(Continued)

FOREIGN PATENT DOCUMENTS

CN 1236824 12/1999
EP 1 227 163 7/2002
(Continued)

OTHER PUBLICATIONS

Extended European Search Report dated May 2, 2016, of corresponding European Application No. 16153621.4.
(Continued)

*Primary Examiner* — Weiping Zhu
(74) *Attorney, Agent, or Firm* — DLA Piper LLP (US)

(57) ABSTRACT

A grain-oriented electrical steel sheet, on which magnetic domain refining treatment by strain application has been performed, has an insulating coating with excellent insulation properties and corrosion resistance. In a grain-oriented electrical steel sheet, linear strain having been applied thereto by irradiation with a high-energy beam, the linear strain extending in a direction that intersects a rolling direction of the steel sheet, an area ratio of irradiation marks within an irradiation region of the high-energy beam is 2% or more and 20% or less, an area ratio of protrusions with a diameter of 1.5 μm or more within a surrounding portion of the irradiation mark is 60% or less, and an area ratio of exposed portions of steel substrate in the irradiation mark is 90% or less.

13 Claims, 5 Drawing Sheets

(a) Case of linear irradiation (b) Case of dot-sequence irradiation

(51) Int. Cl.

| | |
|---|---|
| ***C22C 38/60*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/16*** | (2006.01) |
| ***H01F 1/18*** | (2006.01) |
| ***H01F 41/00*** | (2006.01) |
| ***C21D 1/38*** | (2006.01) |
| ***C23C 8/50*** | (2006.01) |
| ***C23C 8/80*** | (2006.01) |
| *C23C 8/26* | (2006.01) |

(52) U.S. Cl.

CPC ..... *C21D 8/1277* (2013.01); *C21D 8/1294* (2013.01); *C21D 9/46* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/08* (2013.01); *C22C 38/16* (2013.01); *C22C 38/60* (2013.01); *C23C 8/50* (2013.01); *C23C 8/80* (2013.01); *H01F 1/14783* (2013.01); *H01F 1/18* (2013.01); *H01F 41/005* (2013.01); *C21D 8/1283* (2013.01); *C21D 2201/05* (2013.01); *C23C 8/26* (2013.01)

(58) Field of Classification Search

USPC ..... 148/307

See application file for complete search history.

(56) References Cited

U.S. PATENT DOCUMENTS

| | | | |
|---|---|---|---|
| 2005/0126659 | A1 | 6/2005 | Homma et al. |
| 2014/0234638 | A1 | 8/2014 | Takajo et al. |
| 2014/0360629 | A1 | 12/2014 | Inoue et al. |
| 2015/0010762 | A1 | 1/2015 | Yamaguchi et al. |

FOREIGN PATENT DOCUMENTS

| | | | | | |
|---|---|---|---|---|---|
| EP | 2 602 347 | | | 6/2013 | |
| JP | 57-2252 | B2 | | 1/1982 | |
| JP | 58-36051 | | | 8/1983 | |
| JP | 59-229419 | A | | 12/1984 | |
| JP | 59229419 | A | * | 12/1984 | ..... C21D 1/09 |
| JP | 60-218427 | A | | 11/1985 | |
| JP | 62-49322 | B2 | | 10/1987 | |
| JP | 63-83227 | A | | 4/1988 | |
| JP | 1-281709 | A | | 11/1989 | |
| JP | 5-32881 | B2 | | 5/1993 | |
| JP | 6-72266 | B2 | | 9/1994 | |
| JP | 3361709 | B2 | | 1/2003 | |
| JP | 4091749 | B2 | | 5/2008 | |
| JP | 2012-177163 | A | | 9/2012 | |
| KR | 1996-0014945 | | | 10/1996 | |
| WO | 2004/083465 | A1 | | 9/2004 | |
| WO | 2011/125672 | A1 | | 10/2011 | |
| WO | 2011/158519 | | | 12/2011 | |

OTHER PUBLICATIONS

Chinese Office Action dated Mar. 2, 2016, of corresponding Chinese Application No. 201280065124.7, along with a Concise Statement of Relevance of Office Action in English.

Japanese Office Action dated Oct. 20, 2015 with English translation in corresponding Japanese Patent Application No. 2013-551475.

Chinese Office Action dated Jun. 23, 2016, of corresponding Chinese Application No. 201280065124.7, along with a Concise Statement of Relevance of Office Action in English.

Office Action dated May 23, 2016, of related U.S. Appl. No. 14/368,975.

Office Action dated Jan. 6, 2016, of related U.S. Appl. No. 14/368,975.

Chinese Office Action dated Nov. 19, 2018, of counterpart Chinese Application No. 201710096519.8, along with a Search Report in English.

Chinese Office Action dated Mar. 14, 2018, of corresponding Chinese Application No. 201710096519.8, along with a Search Report in English.

Notice of Grounds for Rejection dated May 20, 2015 of corresponding Korean Application No. 2014-7018757 along with its English translation.

Supplementary European Search Report dated Jul. 14, 2015 of corresponding European Application No. 12863996.0.

Chinese Office Action dated Jul. 27, 2015 of corresponding Chinese Application No. 2012800651247 along with its English translation.

Corresponding Office Action of Japanese Application No. 2013-551475 dated Feb. 10, 2015 with English translation.

* cited by examiner (a) Case of linear irradiation (b) Case of dot-sequence irradiation

GRAIN-ORIENTED ELECTRICAL STEEL SHEET AND METHOD OF MANUFACTURING THE SAME

TECHNICAL FIELD

This disclosure relates to a grain-oriented electrical steel sheet advantageously utilized for an iron core of a transformer or the like, and to a method of manufacturing the same.

BACKGROUND

A grain-oriented electrical steel sheet is mainly utilized as an iron core of a transformer and is required to exhibit superior magnetization characteristics, in particular low iron loss.

In this regard, it is important to highly accord secondary recrystallized grains of a steel sheet with (110)[001] orientation, i.e., the "Goss orientation," and reduce impurities in a product steel sheet. Furthermore, since there are limits on controlling crystal grain orientations and reducing impurities, a technique has been developed to introduce non-uniformity into a surface of a steel sheet by physical means to subdivide the width of a magnetic domain to reduce iron loss, i.e., a magnetic domain refining technique.

For example, JP S57-2252 B2 proposes a technique of irradiating a steel sheet as a finished product with a laser to introduce high-dislocation density regions into a surface layer of the steel sheet, thereby narrowing magnetic domain widths and reducing iron loss of the steel sheet. Furthermore, JP H6-072266 B2 proposes a technique of controlling the magnetic domain width by electron beam irradiation.

Thermal strain application-based magnetic domain refinement techniques such as laser beam irradiation and electron beam irradiation have the problem that insulating coating on the steel sheet is damaged by sudden and local thermal application, causing the insulation properties such as interlaminar resistance and withstand voltage, as well as corrosion resistance, to worsen. Therefore, after laser beam irradiation or electron beam irradiation, re-forming is performed on the steel sheet by applying an insulating coating again to the steel sheet and baking the insulating coating in a temperature range at which thermal strain is not eliminated. Re-forming, however, leads to problems such as increased costs due to an additional process, deterioration of magnetic properties due to a worse stacking factor, and the like.

A problem also occurs in that if the damage to the coating is severe, the insulation properties and corrosion resistance cannot be regained even by re-forming, and re-forming simply thickens the coating amount. Thickening the coating amount by re-forming not only worsens the stacking factor, but also damages the adhesion property and appearance of the steel sheet, thus significantly reducing the value of the product.

Against this background, techniques of applying strain while suppressing damage to the insulating coating have been proposed, for example, in JP S62-49322 B2, JP H5-32881 B2, JP 3361709 B2 and JP 4091749 B2. Specifically, to suppress damage to the coating, the methods disclosed in JP '252, JP '266, JP '322, JP '881 and JP '709 adopt approaches such as blurring the focus of the beam or suppressing the beam power to reduce the actual amount of thermal strain applied to the steel sheet. Even if the insulation properties of the steel sheet are maintained, however, the amount of iron loss reduction ends up decreasing. JP '749 discloses a method of reducing the iron loss while maintaining insulation properties by irradiating both sides of a steel sheet with a laser, yet that method is not advantageous in terms of cost, since irradiating both sides of the steel sheet increases the number of treatment steps.

It could therefore be helpful to provide a grain-oriented electrical steel sheet, on which magnetic domain refining treatment by strain application has been performed, having an insulating coating with excellent insulation properties and corrosion resistance.

SUMMARY

To achieve reduced iron loss by magnetic domain refining treatment, it is essential to provide sufficient thermal strain locally on the steel sheet after final annealing. The principle behind a reduction in iron loss through the application of strain is as follows.

First, upon applying strain to a steel sheet, a closure domain is generated originating from the strain. Generation of the closure domain increases the magnetostatic energy of the steel sheet, yet the 180° magnetic domain is subdivided to lower the increased magnetostatic energy, and the iron loss in the rolling direction is reduced. On the other hand, the closure domain causes pinning of the domain wall, suppressing displacement thereof, and leads to increased hysteresis loss. Therefore, strain is preferably applied locally in a range at which the effect of reducing iron loss is not impaired.

As described above, however, irradiating with a locally strong laser beam or electron beam damages the coating (forsterite film and insulating tension coating formed thereon). Therefore, it becomes necessary to re-form an insulating coating on the steel sheet to compensate for the damage. In particular, when the coating is damaged to a great degree, the amount of re-forming needs to be increased to regain the insulation properties. The stacking factor upon use as an iron core of a transformer is thus greatly reduced, resulting in deteriorated magnetic properties.

By examining the degree of damage to the coating in detail, i.e., the relationship between the properties of the irradiation mark region and the iron loss and insulation properties before and after re-forming, we developed a grain-oriented electrical steel sheet for which re-forming is not performed, or on which an insulating coating is only thinly re-formed, that makes iron loss properties compatible with insulation properties.

Specifically, we provide as follows:

(1) A grain-oriented electrical steel sheet, linear strain having been applied thereto by irradiation with a high-energy beam, the linear strain extending in a direction that intersects a rolling direction of the steel sheet, wherein an area ratio of an irradiation mark within an irradiation region of the high-energy beam is 2% or more and 20% or less, an area ratio of a protrusion with a height of 1.5 μm or more within a surrounding portion of the irradiation mark is 60% or less, and an area ratio of an exposed portion of steel substrate in the irradiation mark is 90% or less.

(2) The grain-oriented electrical steel sheet according to (1), comprising an insulating coating formed after the irradiation with the high-energy beam.

(3) The grain-oriented electrical steel sheet according to (1) or (2), wherein the direction in which the linear strain extends forms an angle of 30° or less with a direction orthogonal to the rolling direction of the steel sheet.

(4) A grain-oriented electrical steel sheet, linear strain having been applied thereto by irradiation with a high-energy beam, the linear strain extending in a direction that intersects a rolling direction of the steel sheet, wherein an area ratio of an irradiation mark within an irradiation region of the high-energy beam exceeds 20%, an area ratio of a protrusion with a height of 1.5 μm or more within a surrounding portion of the irradiation mark is 60% or less, an area ratio of an exposed portion of steel substrate in the irradiation mark is 30% or more and 90% or less, and an insulating coating is formed after the irradiation with the high-energy beam.

(5) A method of manufacturing a grain-oriented electrical steel sheet, comprising:

in manufacturing the grain-oriented electrical steel sheet according to (1) by applying, to a grain-oriented electrical steel sheet after final annealing, linear strain extending in a direction that intersects a rolling direction of the steel sheet, applying the linear strain by irradiating, with a continuous laser, a surface of the grain-oriented electrical steel sheet after final annealing.

(6) A method of manufacturing a grain-oriented electrical steel sheet, comprising:

in manufacturing the grain-oriented electrical steel sheet according to (1) by applying, to a grain-oriented electrical steel sheet after final annealing, linear strain extending in a direction that intersects a rolling direction of the steel sheet, applying the linear strain by irradiating, with an electron beam, a surface of the grain-oriented electrical steel sheet after final annealing.

(7) A method of manufacturing a grain-oriented electrical steel sheet, comprising:

in manufacturing the grain-oriented electrical steel sheet according to (4) by applying, to a grain-oriented electrical steel sheet after final annealing, linear strain extending in a direction that intersects a rolling direction of the steel sheet, applying the linear strain by irradiating, with a continuous laser, a surface of the grain-oriented electrical steel sheet after final annealing.

(8) A method of manufacturing a grain-oriented electrical steel sheet, comprising:

in manufacturing the grain-oriented electrical steel sheet according to (4) by applying, to a grain-oriented electrical steel sheet after final annealing, linear strain extending in a direction that intersects a rolling direction of the steel sheet, applying the linear strain by irradiating, with an electron beam, a surface of the grain-oriented electrical steel sheet after final annealing.

(9) The method of manufacturing a grain-oriented electrical steel sheet according to any one of (5) to (8), comprising:

subjecting a cold-rolled sheet for grain-oriented electrical steel to primary recrystallization annealing and then final annealing; and irradiating the grain-oriented electrical steel sheet after final annealing with the high-energy beam, wherein the cold-rolled sheet is subjected to nitriding treatment during or after the primary recrystallization annealing.

It is possible to provide a low-iron loss grain-oriented electrical steel sheet, on which magnetic domain refining treatment by strain application has been performed, having coating properties with excellent insulation properties and corrosion resistance, without re-forming or after re-forming with a thin coating.

BRIEF DESCRIPTION OF THE DRAWINGS

Our steel sheets and methods will be further described below with reference to the accompanying drawings.

REFERENCE SIGNS LIST

1: Coating
2: Irradiation region
3: Irradiation mark

DETAILED DESCRIPTION

As described above, in the grain-oriented electrical steel sheet, the steel sheet properties after beam irradiation need to be restricted to requirements (a) to (c) below. Each requirement is described in detail below:

(a) the area ratio of irradiation mark(s) within an irradiation region of the high-energy beam is 2% or more and 20% or less, or exceeds 20%

(b) the area ratio of protrusion(s) with a height of 1.5 μm or more within a surrounding portion of an irradiation mark is 60% or less (c) the area ratio of exposed portion(s) of the steel substrate in an irradiation mark is 90% or less (and 30% or more in the case of (a) exceeding 20%).

First, before describing the prescriptions in (a) to (c), the definition of each restriction is explained.

Figure 1:
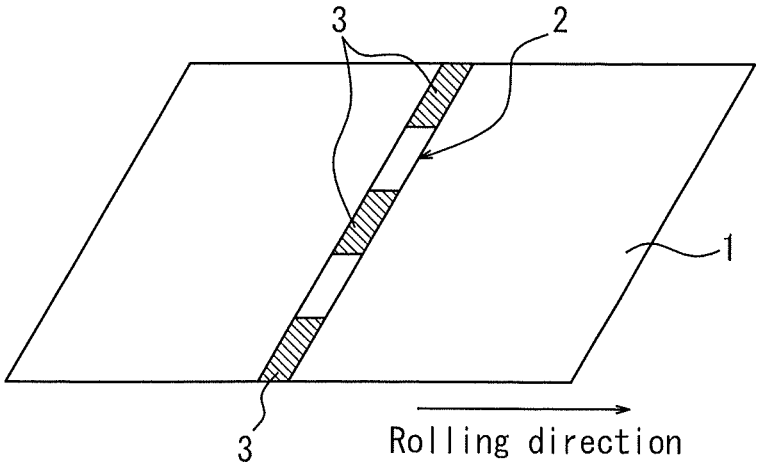
FIG. 1 illustrates irradiation marks on a steel sheet.
Figure 1:
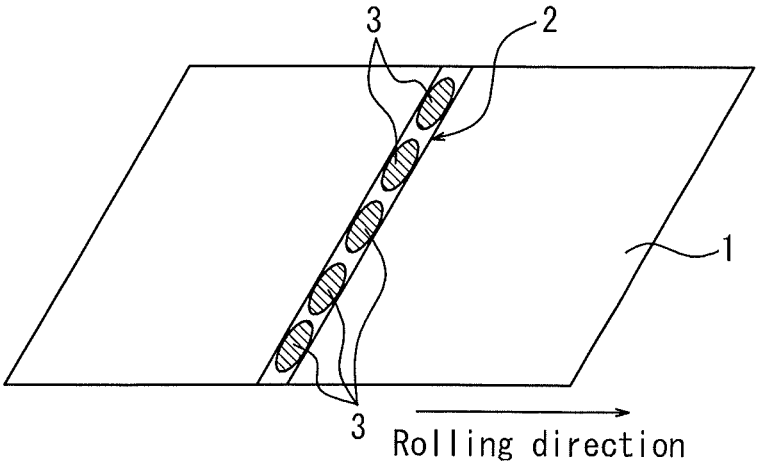

(a) area ratio of irradiation mark(s) within an irradiation region of a high-energy beam FIG. 1(*a*) shows an irradiation region 2 of a high-energy beam (laser beam or electron beam) and irradiation marks 3 when irradiating a coating 1 of a steel sheet surface linearly with the beam, and FIG. 1(*b*) similarly shows irradiating in a dot-sequence manner. Within portions irradiated with a laser beam or electron beam, the irradiation marks 3 refer to portions in which the coating 1 has melted or peeled off under observation with an optical microscope or an electron microscope. The irradiation region 2 of the beam indicates a linear region yielded by connecting the irradiation marks 3 at the same width in the rolling direction. The width is the maximum width of the irradiation marks 3 in the rolling direction. In continuous linear irradiation, the definition of the irradiation region 2 of the beam is the same as the actual region irradiated with the beam, yet in the case of dot-sequence irradiation, each portion between dots that is not actually irradiated with the beam is included. The area ratio of the irradiation marks 3 within the irradiation region 2 as defined above is restricted by the area ratio.

(b) area ratio of protrusion(s) with a height of 1.5 μm or more within a surrounding portion of an irradiation mark The surrounding portion of the irradiation mark indicates a region within 5 μm from the edge of the above-defined irradiation mark 3 outward in the radial direction. In this region, the area ratio where any protrusions with a height of 1.5 μm or more are present is defined as the area ratio of protrusions of 1.5 μm or more within a surrounding portion of an irradiation mark. The area ratio of the protrusions can be measured by measuring surface unevenness with a laser microscope, or by cross-sectional observation of the irradiation mark region with an optical microscope or an electron microscope.

(c) area ratio of exposed portion(s) of the steel substrate in an irradiation mark In the above-defined irradiation mark 3, the area ratio of a portion in which the steel substrate is exposed is defined as the area ratio of a portion in which the steel substrate is exposed in the irradiation mark. Whether the steel substrate is exposed is determined based on EPMA, electron microscope observation, or the like. For example, under reflected electron image observation of the irradiation mark 3, a portion in which steel is exposed is observed as a bright contrast, clearly distinguishable from other portions where the coating remains.

Note that all of the parameters were calculated by observing dot-sequences at five or more locations in a sample measuring 100 mm wide by 400 mm in the rolling direction and then taking the average.

Under a variety of laser irradiation conditions, magnetic domain refining treatment was performed on 0.23 mm thick grain-oriented electrical steel sheets ($B_8$=1.93 T), and samples were used in which each of the following had been changed: area ratio of irradiation marks within an irradiation region of the beam, area ratio of protrusions of 1.5 μm or more within a surrounding portion of an irradiation mark, and area ratio of a portion in which the steel substrate is exposed in the irradiation mark. The following describes, in detail, the results of examining the relationship between these parameters and the iron loss and insulation properties and before and after re-forming, along with the effect of each parameter.

Note that in the experiment, the measurement of interlaminar resistance/current and of withstand voltage was performed as described below.

Interlaminar Resistance/Current

Measurement was performed in conformance with the A method among the measurement methods for an interlaminar resistance test listed in JIS C2550. The total current flowing to the terminal was considered to be the interlaminar resistance/current.

Withstand Voltage

One side of an electrode was connected to an edge of a sample steel substrate, and the other side connected to a pole with 25 mm ϕ and mass of 1 kg. The pole was placed on the surface of the sample, and voltage was gradually applied thereto. The voltage at the time of electrical breakdown was then read. By changing the location of the pole placed on the surface of the sample, measurement was made at five locations. The average was considered to be the measurement value.

Re-forming of the insulating coating was performed by applying 1 g/m$^2$ of an insulating coating mainly including aluminum phosphate and chromic acid to both sides after laser irradiation and then baking in a temperature range at which the magnetic domain refinement effect is not impaired due to release of strain.

(a) area ratio of irradiation mark(s) within an irradiation region of a high-energy beam: 2% or more and 20% or less (or exceeds 20%)

Figure 2:
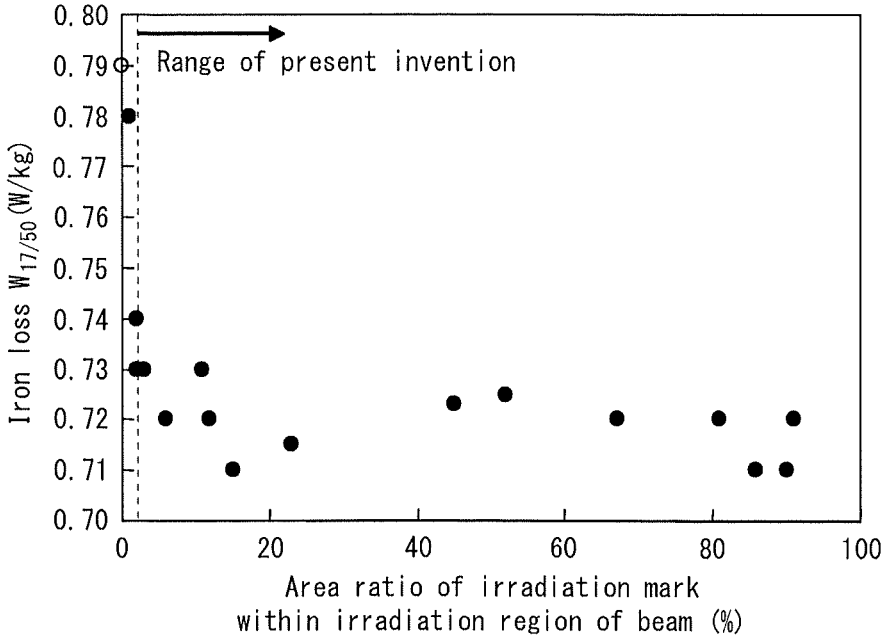
FIG. 2 is a graph showing the relationship between iron loss and the area ratio of irradiation marks within the irradiation region of the beam.
Figure 3:
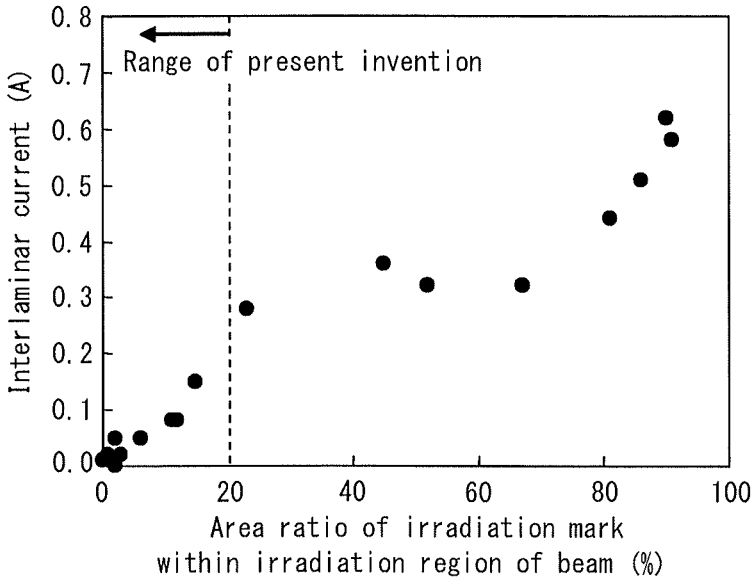
FIG. 3 is a graph showing the relationship between insulation properties before re-forming and the area ratio of irradiation marks within the irradiation region of the beam.
Figure 4:
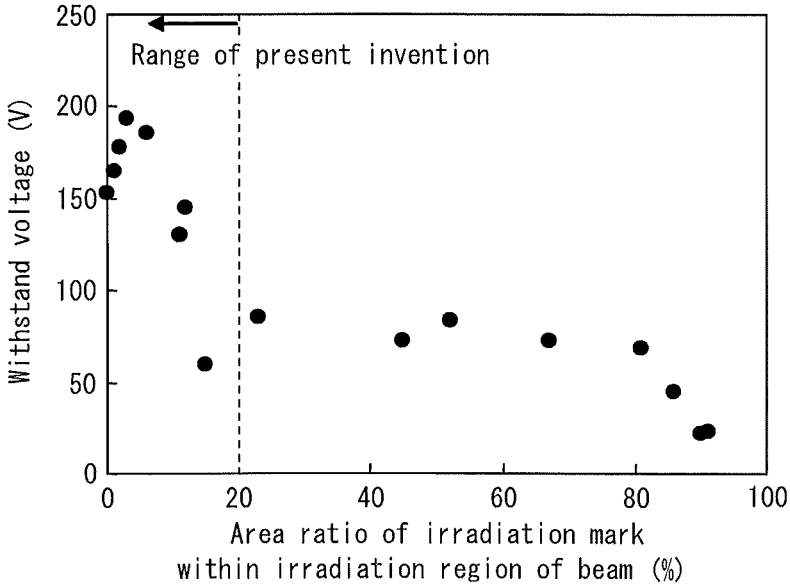
FIG. 4 is a graph showing the relationship between insulation properties before re-forming and the area ratio of irradiation marks within the irradiation region of the beam.

FIG. 2 shows the relationship between iron loss and the area ratio of irradiation marks within the irradiation region of the beam, and FIGS. 3 and 4 show the relationship between insulation properties before re-forming and the area ratio of irradiation marks within the irradiation region of the beam.

As shown in FIG. 2, if the area ratio of the irradiation mark within the irradiation region of the beam is 2% or more, the steel sheet can be provided with a sufficient effect of reducing iron loss. As described above, to achieve a sufficient effect of reducing iron loss, it is important to provide a sufficient amount of thermal strain locally. In other words, FIG. 2 shows that a sufficient amount of thermal strain can be provided locally by beam irradiation in a steel sheet in which the area ratio of the irradiation mark is 2% or more.

Furthermore, from the results shown in FIGS. 3 and 4, it is clear that when the area ratio of the irradiation mark within the irradiation region of the beam is 20% or less, the degree of damage to the coating is small and, therefore, sufficient insulation properties are obtained even without re-forming.

On the other hand, when the area ratio of the irradiation mark exceeds 20%, as described below, the damage to the coating is great, and insulation properties cannot be guaranteed without re-forming.

Figure 5:
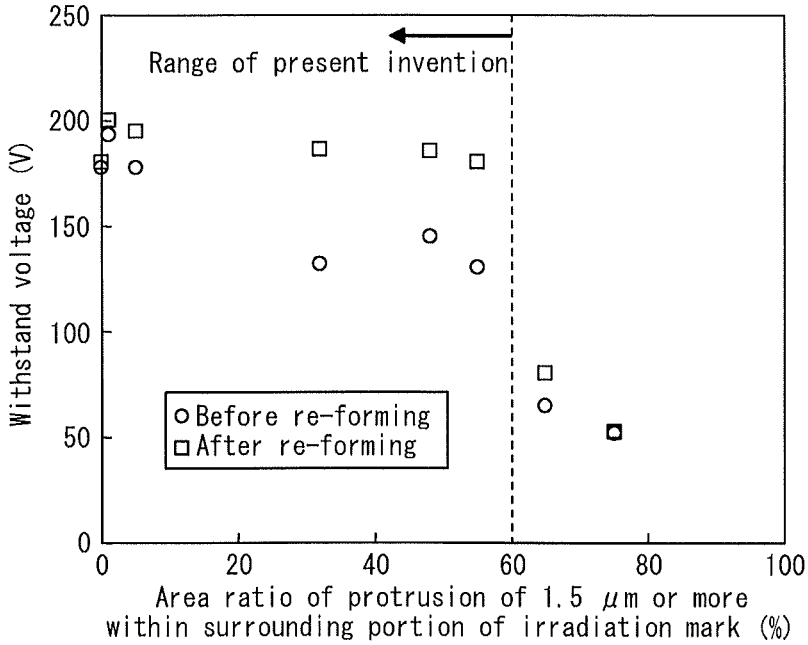
FIG. 5 is a graph showing the relationship between insulation properties before and after re-forming and the area ratio of protrusions of 1.5 μm or more within a surrounding portion of an irradiation mark when the area ratio of the irradiation mark within the irradiation region of the beam is from 2% to 20%.

(b) area ratio of protrusion(s) with a height of 1.5 μm or more within a surrounding portion of an irradiation mark: 60% or less FIG. 5 shows the relationship between insulation properties before and after re-forming and the area ratio of protrusions of 1.5 μm or more at the edge of the irradiation mark region in a sample for which the area ratio of the irradiation mark within the irradiation region of the beam is from 2% to 20%. It is clear that while insulation properties are generally good, the withstand voltage before re-forming reduces when the area ratio of protrusions of 1.5 μm or more within a surrounding portion of an irradiation mark exceeds 60%. We believe that when a protrusion of 1.5 μm or more is present on the surface, then as shown in FIG. 5, the insulation becomes easily damaged due to the distance between the electrode and the steel sheet being reducing by an amount equal to the protrusion at the time of withstand voltage measurement so that the electric potential becomes concentrated.

Figure 6:
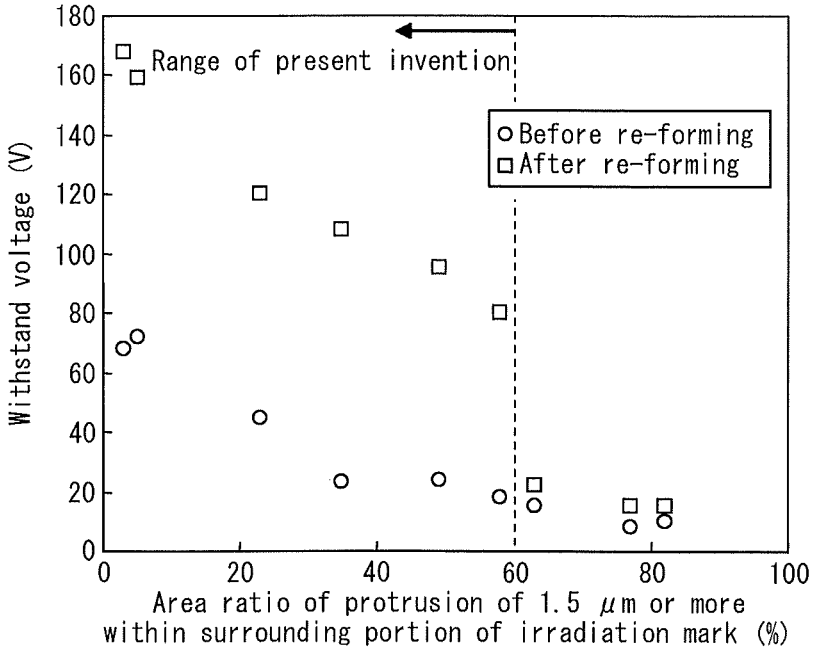
FIG. 6 is a graph showing the relationship between insulation properties before and after re-forming and the area ratio of protrusions of 1.5 μm or more within a surrounding portion of an irradiation mark when the area ratio of the irradiation mark within the irradiation region of the beam is from 21% to 100%.

FIG. 6 shows a study of the relationship between insulation properties before and after re-forming and the area ratio of protrusions of 1.5 μm or more within a surrounding portion of an irradiation mark in a sample for which the area ratio of the irradiation mark within the irradiation region of the beam is from over 20% to 100%. The withstand voltage before re-forming is generally small. Furthermore, even after re-forming, the increase in the withstand voltage is small for an application amount of 1 g/m$^2$ when the area ratio of protrusions of 1.5 μm or more at the edge of the irradiation mark region exceeds 60%. It is thought that when protrusions of 1.5 μm or more were present on the surface, the protrusions were not completely eliminated by a small amount of re-forming, and insulation was not regained.

(c) area ratio of exposed portion(s) of the steel substrate in an irradiation mark: 90% or less (and 30% or more in the case of (a) exceeding 20%)

Figure 7:
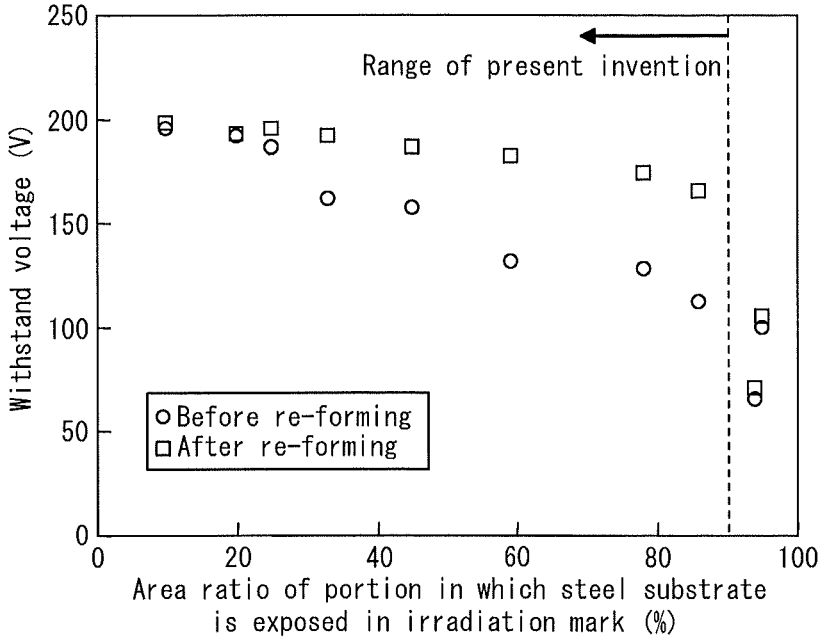
FIG. 7 is a graph showing the relationship between insulation properties before and after re-forming and the area ratio of a portion in which the steel substrate is exposed in an irradiation mark when the area ratio of the irradiation mark within the irradiation region of the beam is from 2% to 20% and the area ratio of protrusions of 1.5 μm or more is 60% or less.

FIG. 7 shows a study of the relationship between insulation properties before and after re-forming and the area ratio of a portion in which the steel substrate is exposed in an irradiation mark in a sample for which the area ratio of the irradiation mark within the irradiation region of the beam is from 2% to 20% and the area ratio of protrusions of 1.5 μm or more is 60% or less. It is clear that while insulation properties are generally good, the withstand voltage before re-forming is particularly large when the area ratio of a portion in which the steel substrate is exposed in an irradiation mark is 90% or less.

Figure 8:
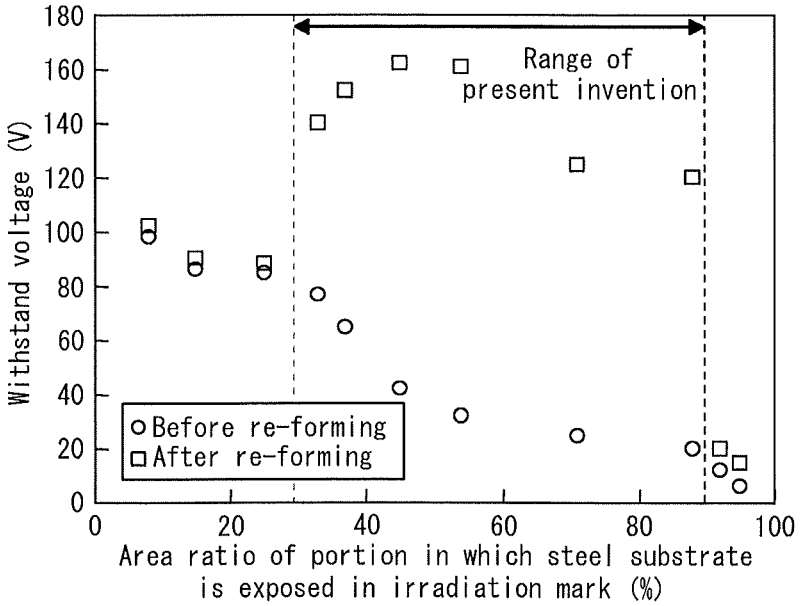
FIG. 8 is a graph showing the relationship between insulation properties before and after re-forming and the area ratio of a portion in which the steel substrate is exposed in an irradiation mark when the area ratio of irradiation marks within the irradiation region of the beam is from 21% to 100% and the area ratio of protrusions of 1.5 μm or more is 60% or less.

On the other hand, FIG. 8 shows a study of the relationship between insulation properties before and after re-forming and the area ratio of a portion in which the steel substrate is exposed in an irradiation mark in a sample for which the area ratio of the irradiation mark within the irradiation region of the beam is from over 20% to 100% and the area ratio of protrusions of 1.5 μm or more is 60% or less. The withstand voltage before re-forming is generally small. In particular, upon exceeding 90%, it is clear that the withstand voltage reduces. Furthermore, focusing on the amount of increase in the withstand voltage from before to after re-forming, it is clear that the amount of increase is small in a region smaller than 30%. Upon observing the irradiation mark region after re-forming in a sample with an area ratio of a portion in which the steel substrate is exposed of less than 30%, multiple cracks and holes were visible in the coating surface, and it was clear that coating formation did not proceed well. While the reason is uncertain, we believe that upon a reduction in the exposed portion of the steel substrate, the wettability of the irradiation mark region when applying the coating liquid in the irradiation mark region worsens, resulting in the occurrence of cracks and holes.

In light of the above experiment results, the properties of the irradiation mark region were restricted to the above conditions (a) to (c). By placing such restrictions, we developed a new grain-oriented electrical steel sheet having excellent insulation properties without re-forming, or having excellent insulation properties after re-forming with a thin coating, and that makes iron loss properties compatible with insulation properties with only re-forming with a thin coating.

Next, a method of manufacturing a steel sheet under the above requirements is described.

First, as a magnetic domain refinement technique, a high-energy beam such as laser irradiation or electron beam irradiation that can apply a large energy by focusing the beam diameter is adopted. As a magnetic domain refinement technique other than laser irradiation and electron beam irradiation, plasma jet irradiation is well known. However, laser irradiation or electron beam irradiation is preferable to achieve desired iron loss.

These magnetic domain refinement techniques are described in order, starting with laser irradiation.

The form of laser oscillation is not particularly limited and may be fiber, $CO_2$, YAG, or the like, yet a continuous irradiation type laser is adopted. Pulse oscillation type laser irradiation such as a Q-switch type, irradiates a large amount of energy at once, resulting in great damage to the coating and making it difficult to keep the irradiation mark within the restrictions of our methods when the magnetic domain refinement effect is in a sufficient range. The beam diameter is a value uniquely set from the collimator, the lens focal distance, and the like in the optical system. The beam diameter may be in the shape of a circle or an ellipse.

At the time of laser irradiation, when the average laser power P (W), beam scanning rate V (m/s), and beam diameter d (mm) are within the ranges below, the above conditions (a) to (c) are preferably satisfied.

$$10\ W\cdot s/m \leq P/V \leq 35\ W\cdot s/m$$

$$V \leq 30\ m/s$$

$$d \geq 0.20\ mm$$

P/V indicates the energy heat input per unit length. At 10 W·s/m or less, the heat input is small, and a sufficient magnetic domain refinement effect is not achieved. Conversely, at 35 W·s/m or more, the heat input is large, and damage to the coating is too great. Therefore, the properties of the irradiation mark region are not achieved.

When the heat input is the same, damage to the coating lessens as the beam scanning rate V is slower. The reason is that when the scanning rate is low, the rate of diffusion of heat provided by the beam irradiation increases, and the energy received by the steel sheet immediately below the beam decreases. Upon exceeding 30 m/s, the damage to the coating becomes great, and the properties of the irradiation mark region are not achieved. The lower limit on the rate is not particularly prescribed, but from the perspective of productivity, 5 m/s or more is preferable.

As the beam diameter d decreases, the heat input per unit area increases, and the damage to the coating becomes great. In the above P/V range, when d is 0.20 mm or less, the properties of the irradiation mark region are not achieved. The upper limit is not particularly prescribed, yet to obtain a sufficient magnetic domain refinement effect in the above P/V range, approximately 0.85 mm or less is preferable.

Next, conditions for magnetic domain refinement by electron beam irradiation are described.

At the time of electron beam irradiation, when the acceleration voltage E (kV), beam current I (mA), and beam scanning rate V (m/s) are within the ranges below, the properties of the irradiation mark preferably satisfy the above conditions.

$$40\ \text{kV} \leq E \leq 150\ \text{kV}$$

$$6\ \text{mA} \leq I \leq 12\ \text{mA}$$

$$V \leq 40\ \text{m/s}$$

If the acceleration voltage E and the beam current I are larger than the above ranges, the magnetic domain refinement effect increases, yet the heat input per unit length grows large, making it difficult to achieve the desired irradiation mark properties. Conversely, setting the acceleration voltage E and the beam current I to be smaller than the above ranges is not appropriate, since the magnetic domain refinement effect grows small.

As with the laser above, when the heat input is the same, damage to the coating lessens as the beam scanning rate V is slower. At 40 m/s or more, the damage to the coating becomes great, and the properties of the desired irradiation mark region are not achieved. The lower limit on the scanning rate is not particularly prescribed, but from the perspective of productivity, 10 m/s or more is preferable.

As for the degree of vacuum (pressure in the working chamber), the pressure in the working chamber in which the steel sheet is irradiated with the electron beam is preferably 2 Pa or less. If the degree of vacuum is lower (i.e., if pressure is greater), the beam loses focus due to residual gas along the way from the electron gun to the steel sheet, thus reducing the magnetic domain refinement effect.

Since the beam diameter changes depending on factors such as the acceleration voltage, the beam current, and the degree of vacuum, no suitable range is particularly designated, yet a range of approximately 0.10 mm to 0.40 mm is preferable. This diameter is prescribed for the half width of the energy profile using a known slit method.

The steel sheets may be irradiated continuously or in a dot-sequence manner. A method to apply strain in a dot-sequence is realized by repeating a process to scan the beam rapidly while stopping for dots at predetermined intervals of time, continuously irradiating the steel sheet with the beam for each dot for an amount of time conforming to our methods before restarting the scan. To implement this process with electron beam irradiation, a large capacity amplifier may be used to vary the diffraction voltage of the electron beam. When irradiating in a dot-sequence manner, the interval between dots is preferably 0.40 mm or less, since the magnetic domain refinement effect decreases if the interval is too large.

The interval in the rolling direction between irradiation rows for magnetic domain refinement by electron beam irradiation is unrelated to our steel sheet properties, yet to increase the magnetic domain refinement effect, this interval is preferably 3 mm to 5 mm. Furthermore, the direction of irradiation is preferably 30° or less with respect to a direction orthogonal to the rolling direction and is more preferably orthogonal to the rolling direction.

Other than the above points, the method of manufacturing the grain-oriented electrical steel sheet is not particularly limited, yet the following describes a recommended preferable chemical composition and a method of manufacturing.

The chemical composition may contain appropriate amounts of Al and N when an inhibitor, e.g., an AlN-based inhibitor, is used or appropriate amounts of Mn and Se and/or S when an MnS.MnSe-based inhibitor is used. Of course, these inhibitors may also be used in combination.

In this case, preferred contents of Al, N, S and Se are: Al: 0.01 mass % to 0.065 mass %; N: 0.005 mass % to 0.012 mass %; S: 0.005 mass % to 0.03 mass %; and Se: 0.005 mass % to 0.03 mass %, respectively.

We also provide a grain-oriented electrical steel sheet having limited contents of Al, N, S and Se without using an inhibitor.

In this case, the contents of Al, N, S and Se are preferably limited to Al: 100 mass ppm or less, N: 50 mass ppm or less, S: 50 mass ppm or less, and Se: 50 mass ppm or less, respectively.

Other basic components and optionally added components are as follows.

C: 0.08 mass % or less

If the C content exceeds 0.08 mass %, it becomes difficult to reduce the C content to 50 mass ppm or less, at which point magnetic aging will not occur during the manufacturing process. Therefore, the C content is preferably 0.08 mass % or less. It is not necessary to set a particular lower limit on the C content, because secondary recrystallization is enabled by a material not containing C.

Si: 2.0 mass % to 8.0 mass %

Silicon (Si) is an element effective to enhance electrical resistance of steel and improve iron loss properties thereof. If the content is less than 2.0 mass %, however, a sufficient iron loss reduction effect is difficult to achieve. On the other hand, a content exceeding 8.0 mass % significantly deteriorates formability and also decreases the flux density of the steel. Therefore, the Si content is preferably 2.0 mass % to 8.0 mass %.

Mn: 0.005 mass % to 1.0 mass %

Manganese (Mn) is preferably added to achieve better hot workability of steel. However, this effect is inadequate when the Mn content in steel is below 0.005 mass %. On the other hand, Mn content in steel above 1.0 mass % deteriorates magnetic flux of a product steel sheet. Accordingly, the Mn content is preferably 0.005 mass % to 1.0 mass %.

Furthermore, in addition to the above basic components, the following elements may also be included as deemed appropriate to improve magnetic properties:

- at least one element selected from Ni: 0.03 mass % to 1.50 mass %,
- Sn: 0.01 mass % to 1.50 mass %, Sb: 0.005 mass % to 1.50 mass %,
- Cu: 0.03 mass % to 3.0 mass %, P: 0.03 mass % to 0.50 mass %,
- Mo: 0.005 mass % to 0.10 mass %, and Cr: 0.03 mass % to 1.50 mass %.

Nickel (Ni) is an element useful in improving the texture of a hot rolled steel sheet for better magnetic properties thereof. However, Ni content in steel below 0.03 mass % is less effective in improving magnetic properties, while Ni content in steel above 1.5 mass % makes secondary recrystallization of the steel unstable, thereby deteriorating the magnetic properties thereof. Thus, Ni content is preferably 0.03 mass % to 1.5 mass %.

In addition, tin (Sn), antimony (Sb), copper (Cu), phosphorus (P), chromium (Cr), and molybdenum (Mo) are useful elements in terms of improving magnetic properties of steel. However, each of these elements becomes less effective in improving magnetic properties of the steel when contained in steel in an amount less than the aforementioned lower limit and inhibits the growth of secondary recrystallized grains of the steel when contained in steel in an amount exceeding the aforementioned upper limit. Thus, each of these elements is preferably contained within the respective ranges thereof specified above. The balance other than the above-described elements is Fe and incidental impurities that are incorporated during the manufacturing process.

Steel material adjusted to the above preferable chemical composition may be formed into a slab by normal ingot casting or continuous casting, or a thin slab or thinner cast steel with a thickness of 100 mm or less may be manufactured by direct continuous casting. The slab may be either heated by a normal method of hot rolling or directly subjected to hot rolling after casting without being heated. A thin slab or thinner cast steel may be either hot rolled or directly used in the next process by omitting hot rolling. After performing hot band annealing as necessary, the material is formed as a cold rolled sheet with the final sheet thickness by cold rolling once, or two or more times with intermediate annealing therebetween. Subsequently, after subjecting the cold rolled sheet to primary recrystallization annealing (decarburizing annealing) and then final annealing, an insulating tension coating is applied, and the cold rolled sheet is subjected to flattening annealing to yield a grain-oriented electrical steel sheet with an insulating coating. Subsequently, magnetic domain refining treatment is performed by irradiating the grain-oriented electrical steel sheet with a laser or an electron beam. Furthermore, re-forming of the insulating coating is performed under the above requirements to yield a desirable product.

During or after primary recrystallization annealing (decarburizing annealing), to strengthen the inhibitor function, the cold-rolled sheet may be subjected to nitriding treatment with an increase in the nitrogen amount of 50 ppm or more and 1000 ppm or less. In the case of performing this nitriding treatment, when performing magnetic domain refining treatment by laser irradiation or electron beam irradiation after the nitriding treatment, damage to the coating tends to increase as compared to when the nitriding treatment is not performed, and the corrosion resistance and insulation properties after re-forming worsen significantly. Accordingly, application of our methods is particularly effective when performing nitriding treatment. While the reason is unclear, we believe that the structure of the base film formed during final annealing changes, exacerbating exfoliation of the film.

Example 1

Cold-rolled sheets for grain-oriented electrical steel sheets, rolled to a final sheet thickness of 0.23 mm and containing Si: 3.25 mass %, Mn: 0.04 mass %, Ni: 0.01 mass %, Al: 60 mass ppm, S: 20 mass ppm, C: 250 mass ppm, O: 16 mass ppm, and N: 40 mass ppm were decarburized. After primary recrystallization annealing, an annealing separator containing MgO as the primary component was applied, and final annealing including a secondary recrystallization process and a purification process was performed to yield grain-oriented electrical steel sheets with a forsterite film. The coating liquid A below was then applied to the steel sheets, and an insulating coating was formed by baking at 800° C. Subsequently, magnetic domain refining treatment was applied by performing continuous fiber laser irradiation, or Q switch pulse laser irradiation, on the insulating coating in a direction perpendicular to the rolling direction, and at 3 mm intervals in the rolling direction. As a result, material with a magnetic flux density $B_8$ of 1.92 T to 1.94 T was obtained.

The irradiation region was observed with an electron microscope to verify the properties of the irradiation mark. Furthermore, in the same way as above, the interlaminar current and the withstand voltage were measured. Subsequently, as re-forming treatment, 1 g/m$^2$ of the coating liquid B below was applied to both sides of the steel sheets, and the steel sheets were baked in a range at which the magnetic domain refinement effect is not impaired due to release of strain. The interlaminar current and withstand voltage were then once again measured in the same way as described above. Furthermore, the 1.7 T and 50 Hz iron loss $W_{17/50}$ were measured in a single sheet tester (SST). Table 1 summarizes the measurement results.

Coating liquid A: liquid containing 100 cc of 20% aqueous dispersion of colloidal silica, 60 cc of 50% aqueous solution of aluminum phosphate, 15 cc of approximately 25% aqueous solution of magnesium chromate, and 3 g of boric acid Coating liquid B: liquid containing 60 cc of 50% aqueous solution of aluminum phosphate, 15 cc of approximately 25% aqueous solution of magnesium chromate, 3 g of boric acid, and 100 cc of water (not including colloidal silica)

As Table 1 shows, before re-forming, or after re-forming with a thin coating, the steel sheets satisfying the ranges of the desired irradiation mark properties satisfied a shipping standard of 0.2 A or less for interlaminar resistance and 60 V or more for withstand voltage.

TABLE 1

| | Laser irradiation conditions | | | | | Degree of damage to the coating | | | Insulation properties before re-forming | | Insulation properties after re-forming | | | |
|---|---|---|---|---|---|---|---|---|---|---|---|---|---|---|
| Condition | Irradiation pattern | Dot-sequence pitch (mm) | Beam power (W) | Beam diameter (mm) | Scanning rate (ms/s) | Ratio of irradiation mark within irradiation region of beam (%) | Ratio of protrusion of 1.5 μm or more at edge of irradiation mark region (%) | Ratio of exposed portion of steel substrate in irradiation mark (%) | Interlaminar current (A) | Withstand voltage (V) | Interlaminar current (A) | Withstand voltage (V) | Iron loss $W_{17/50}$ (W/kg) | Notes |
| 1 | continuous | — | 100 | 0.80 | 10 | 0 | 3 | — | 0.01 | 153 | 0.00 | 178 | 0.78 | Comparative Example |
| 2 | continuous | — | 125 | 0.80 | 10 | 2 | 3 | 5 | 0.01 | 160 | 0.00 | 182 | 0.74 | Example |
| 3 | continuous | — | 150 | 0.80 | 10 | 2 | 3 | 5 | 0.00 | 178 | 0.00 | 180 | 0.74 | Example |
| 4 | continuous | — | 100 | 0.60 | 10 | 1 | 0 | — | 0.02 | 165 | 0.01 | 169 | 0.77 | Comparative |

TABLE 1-continued

| | Laser irradiation conditions | | | | | Degree of damage to the coating | | | Insulation properties before re-forming | | Insulation properties after re-forming | | | |
|---|---|---|---|---|---|---|---|---|---|---|---|---|---|---|
| Condition | Irradiation pattern | Dot-sequence pitch (mm) | Beam power (W) | Beam diameter (mm) | Scanning rate (ms/s) | Ratio of irradiation mark within irradiation region of beam (%) | Ratio of protrusion of 1.5 μm or more at edge of irradiation mark region (%) | Ratio of exposed portion of steel substrate in irradiation mark (%) | Inter-laminar current (A) | Withstand voltage (V) | Inter-laminar current (A) | Withstand voltage (V) | Iron loss $W_{17/50}$ (W/kg) | Notes |
| 5 | continuous | — | 125 | 0.60 | 10 | 3 | 4 | 12 | 0.02 | 171 | 0.00 | 185 | 0.74 | Example |
| 6 | continuous | — | 150 | 0.60 | 10 | 3 | 1 | 20 | 0.02 | 193 | 0.00 | 200 | 0.73 | Example |
| 7 | continuous | — | 100 | 0.50 | 10 | 1 | 5 | 6 | 0.05 | 178 | 0.02 | 185 | 0.78 | Comparative Example |
| 8 | continuous | — | 150 | 0.50 | 10 | 6 | 15 | 23 | 0.05 | 186 | 0.02 | 186 | 0.72 | Example |
| 9 | continuous | — | 75 | 0.40 | 5 | 12 | 29 | 30 | 0.08 | 145 | 0.03 | 150 | 0.72 | Example |
| 10 | continuous | — | 150 | 0.40 | 10 | 13 | 43 | 45 | 0.08 | 130 | 0.02 | 180 | 0.73 | Example |
| 11 | continuous | — | 225 | 0.40 | 15 | 18 | 49 | 52 | 0.53 | 12 | 0.05 | 190 | 0.71 | Example |
| 12 | continuous | — | 225 | 0.40 | 17 | 20 | 58 | 60 | 0.58 | 9 | 0.05 | 187 | 0.71 | Example |
| 13 | Pulse | 1.0 | 150 | 0.05 | 10 | 17 | 21 | 92 | 0.42 | 50 | 0.28 | 65 | 0.82 | Comparative Example |
| 14 | Pulse | 1.0 | 100 | 0.05 | 10 | 16 | 65 | 85 | 0.62 | 8 | 0.45 | 25 | 0.80 | Comparative Example |
| 15 | continuous | — | 200 | 0.50 | 10 | 22 | 23 | 52 | 0.25 | 72 | 0.02 | 151 | 0.72 | Example |
| 16 | continuous | — | 250 | 0.50 | 10 | 35 | 32 | 66 | 0.35 | 45 | 0.03 | 141 | 0.72 | Example |
| 17 | continuous | — | 300 | 0.50 | 10 | 78 | 45 | 87 | 0.45 | 15 | 0.09 | 78 | 0.72 | Example |
| 18 | continuous | — | 350 | 0.50 | 10 | 92 | 85 | 97 | 0.78 | 6 | 0.72 | 11 | 0.73 | Comparative Example |
| 19 | continuous | — | 75 | 0.30 | 5 | 25 | 2 | 28 | 0.34 | 85 | 0.28 | 88 | 0.72 | Comparative Example |
| 20 | continuous | — | 150 | 0.30 | 10 | 42 | 0 | 35 | 0.36 | 72 | 0.10 | 198 | 0.72 | Example |
| 21 | continuous | — | 225 | 0.30 | 15 | 51 | 1 | 42 | 0.32 | 83 | 0.05 | 161 | 0.72 | Example |
| 22 | continuous | — | 100 | 0.30 | 5 | 81 | 3 | 55 | 0.44 | 68 | 0.03 | 180 | 0.72 | Example |
| 23 | continuous | — | 200 | 0.30 | 10 | 67 | 5 | 50 | 0.32 | 72 | 0.02 | 186 | 0.72 | Example |
| 24 | continuous | — | 300 | 0.30 | 20 | 87 | 23 | 68 | 0.51 | 45 | 0.04 | 172 | 0.71 | Example |
| 25 | continuous | — | 375 | 0.30 | 25 | 92 | 52 | 77 | 0.72 | 8 | 0.12 | 101 | 0.71 | Example |
| 26 | continuous | — | 450 | 0.30 | 30 | 95 | 75 | 95 | 0.89 | 5 | 0.80 | 12 | 0.71 | Comparative Example |
| 27 | continuous | — | 125 | 0.25 | 10 | 86 | 27 | 60 | 0.55 | 40 | 0.05 | 160 | 0.72 | Example |
| 28 | continuous | — | 150 | 0.25 | 10 | 91 | 35 | 72 | 0.58 | 23 | 0.08 | 123 | 0.72 | Example |
| 29 | continuous | — | 200 | 0.25 | 10 | 90 | 55 | 71 | 0.62 | 22 | 0.15 | 95 | 0.71 | Example |
| 30 | continuous | — | 250 | 0.25 | 20 | 91 | 39 | 75 | 0.61 | 21 | 0.06 | 141 | 0.72 | Example |

TABLE 1-continued

| | Laser irradiation conditions | | | | | Degree of damage to the coating | | | Insulation properties before re-forming | | Insulation properties after re-forming | | | |
|---|---|---|---|---|---|---|---|---|---|---|---|---|---|---|
| Condition | Irradiation pattern | Dot-sequence pitch (mm) | Beam power (W) | Beam diameter (mm) | Scanning rate (ms/s) | Ratio of irradiation mark within irradiation region of beam (%) | Ratio of protrusion of 1.5 μm or more at edge of irradiation mark region (%) | Ratio of exposed portion of steel substrate in irradiation mark (%) | Interlaminar current (A) | Withstand voltage (V) | Interlaminar current (A) | Withstand voltage (V) | Iron loss $W_{17/50}$ (W/kg) | Notes |
| 31 | continuous | — | 375 | 0.25 | 25 | 95 | 55 | 76 | 0.90 | 7 | 0.16 | 95 | 0.72 | Example |
| 32 | continuous | — | 500 | 0.25 | 30 | 96 | 71 | 88 | 0.91 | 7 | 0.21 | 55 | 0.72 | Comparative Example |
| 33 | continuous | — | 140 | 0.20 | 10 | 88 | 60 | 80 | 0.60 | 18 | 0.18 | 72 | 0.70 | Example |
| 34 | continuous | — | 150 | 0.20 | 10 | 91 | 61 | 82 | 0.61 | 13 | 0.41 | 30 | 0.70 | Comparative Example |
| 35 | continuous | — | 200 | 0.20 | 10 | 95 | 62 | 85 | 0.64 | 10 | 0.39 | 27 | 0.70 | Comparative Example |
| 36 | continuous | — | 200 | 0.10 | 10 | 92 | 78 | 87 | 0.63 | 12 | 0.42 | 22 | 0.70 | Comparative Example |
| 37 | continuous | — | 225 | 0.10 | 15 | 91 | 80 | 95 | 0.69 | 10 | 0.63 | 18 | 0.69 | Comparative Example |
| 38 | pulse | 0.5 | 100 | 0.15 | 10 | 58 | 65 | 85 | 0.52 | 8 | 0.45 | 25 | 0.73 | Comparative Example |
| 39 | pulse | 0.5 | 150 | 0.15 | 10 | 56 | 30 | 90 | 0.53 | 8 | 0.19 | 63 | 0.72 | Example |
| 40 | pulse | 0.5 | 175 | 0.15 | 10 | 69 | 2 | 92 | 0.55 | 15 | 0.47 | 33 | 0.73 | Comparative Example |
| 41 | pulse | 0.3 | 175 | 0.15 | 10 | 90 | 0 | 98 | 0.63 | 10 | 0.52 | 28 | 0.70 | Comparative Example |

Example 2

Cold-rolled sheets for grain-oriented electrical steel sheets, rolled to a final sheet thickness of 0.23 mm and containing similar components to Example 1 were decarburized. After primary recrystallization annealing, an annealing separator containing MgO as the primary component was applied, and final annealing including a secondary recrystallization process and a purification process was performed to yield grain-oriented electrical steel sheets with a forsterite film. The coating liquid A in the above-described Example 1 was then applied to the steel sheets, and an insulating coating was formed by baking at 800° C. Subsequently, magnetic domain refining treatment was applied by dot-sequence irradiation or continuous irradiation, with an electron beam at a degree of vacuum in the working chamber of 1 Pa, on the insulating coating in a direction perpendicular to the rolling direction, and at 3 mm intervals in the rolling direction. As a result, material with a magnetic flux density $B_g$ of 1.92 T to 1.94 T was obtained.

The irradiation region was observed with an electron microscope to verify the properties of the irradiation mark. Furthermore, in the same way as above, the interlaminar current and the withstand voltage were measured. Subsequently, as re-forming treatment, 1 g/m$^2$ of the coating liquid B in the above-described Example 1 was applied to both sides of the steel sheets, and the steel sheets were baked in a range at which the magnetic domain refinement effect is not impaired due to release of strain. The interlaminar current and the withstand voltage were then measured again. Furthermore, the 1.7 T and 50 Hz iron loss $W_{17/50}$ was measured in a single sheet tester (SST). Table 2 summarizes the measurement results.

As Table 2 shows, before re-forming, or after re-forming with a thin coating, the steel sheets satisfying the ranges of the desired irradiation mark properties satisfied a shipping standard of 0.2 A or less for interlaminar resistance and 60 V or more for withstand voltage.

TABLE 2

| Condition | Laser irradiation conditions | | | | | | Degree of damage to the coating | |
|---|---|---|---|---|---|---|---|---|
| | Irradiation pattern | Dot-sequence pitch (mm) | Acceleration voltage (kV) | Beam current (mA) | Scanning rate (m/s) | Beam diameter (mm) | Ratio of irradiation mark within irradiation region of beam (%) | Ratio of protrusion of 1.5 mm or more at edge of irradiation mark region (%) |
| 1 | dot-sequence | 0.32 | 30 | 12 | 20 | 0.50 | 0 | — |
| 2 | dot-sequence | 0.32 | 35 | 12 | 20 | 0.46 | 0 | — |
| 3 | dot-sequence | 0.32 | 40 | 10 | 20 | 0.39 | 3 | 2 |
| 4 | dot-sequence | 0.32 | 60 | 7 | 20 | 0.32 | 23 | 2 |
| 5 | dot-sequence | 0.32 | 80 | 7 | 20 | 0.28 | 25 | 4 |
| 6 | dot-sequence | 0.32 | 100 | 7 | 20 | 0.26 | 34 | 5 |
| 7 | dot-sequence | 0.32 | 120 | 6 | 20 | 0.24 | 45 | 8 |
| 8 | dot-sequence | 0.32 | 150 | 6 | 20 | 0.16 | 49 | 12 |
| 9 | dot-sequence | 0.32 | 170 | 5 | 20 | 0.12 | 49 | 15 |
| 10 | dot-sequence | 0.32 | 60 | 3 | 20 | 0.25 | 0 | — |
| 11 | dot-sequence | 0.32 | 60 | 4 | 20 | 0.25 | 2 | 2 |
| 12 | dot-sequence | 0.32 | 60 | 6 | 20 | 0.30 | 21 | 2 |
| 13 | dot-sequence | 0.32 | 60 | 8 | 20 | 0.35 | 25 | 3 |
| 14 | dot-sequence | 0.32 | 60 | 10 | 20 | 0.37 | 33 | 10 |
| 15 | dot-sequence | 0.32 | 60 | 12 | 20 | 0.39 | 42 | 58 |
| 16 | dot-sequence | 0.32 | 60 | 12.5 | 20 | 0.39 | 45 | 60 |
| 17 | dot-sequence | 0.32 | 60 | 13 | 20 | 0.45 | 49 | 62 |
| 18 | dot-sequence | 0.32 | 60 | 4 | 8 | 0.26 | 21 | 3 |
| 19 | dot-sequence | 0.32 | 60 | 5 | 10 | 0.28 | 25 | 3 |
| 20 | dot-sequence | 0.32 | 60 | 6 | 15 | 0.31 | 26 | 5 |
| 21 | dot-sequence | 0.32 | 60 | 7 | 25 | 0.32 | 32 | 7 |
| 22 | dot-sequence | 0.32 | 60 | 8 | 30 | 0.36 | 18 | 2 |
| 23 | dot-sequence | 0.32 | 60 | 9 | 35 | 0.38 | 5 | 0 |
| 24 | dot-sequence | 0.32 | 60 | 10 | 40 | 0.41 | 21 | 5 |
| 25 | dot-sequence | 0.32 | 60 | 12 | 45 | 0.43 | 51 | 75 |
| 26 | dot-sequence | 0.08 | 60 | 10 | 20 | 0.35 | 96 | 24 |
| 27 | dot-sequence | 0.12 | 60 | 10 | 20 | 0.35 | 95 | 21 |
| 28 | dot-sequence | 0.16 | 60 | 10 | 20 | 0.35 | 91 | 15 |
| 29 | dot-sequence | 0.20 | 60 | 10 | 20 | 0.35 | 72 | 12 |
| 30 | dot-sequence | 0.25 | 60 | 10 | 20 | 0.35 | 71 | 11 |
| 31 | dot-sequence | 0.40 | 60 | 10 | 20 | 0.35 | 38 | 3 |
| 32 | dot-sequence | 0.45 | 60 | 10 | 20 | 0.35 | 29 | 1 |
| 33 | continuous | — | 60 | 12 | 25 | 0.41 | 95 | 45 |
| 34 | continuous | — | 60 | 10 | 25 | 0.36 | 62 | 21 |

TABLE 2-continued

| | | | | | | | | |
|---|---|---|---|---|---|---|---|---|
| 35 | continuous | — | 60 | 8 | 25 | 0.29 | 35 | 10 |
| 36 | continuous | — | 60 | 6 | 25 | 0.25 | 1 | 3 |
| 37 | continuous | — | 60 | 3 | 25 | 0.25 | 0 | — |

| Condition | Degree of damage to the coating Ratio of exposed portion of steel substrate in irradiation mark (%) | Insulation properties before re-forming: Inter-laminar current (A) | Insulation properties before re-forming: With-stand voltage (V) | Insulation properties after re-forming: Inter-laminar current (A) | Insulation properties after re-forming: With-stand voltage (V) | Iron loss $W_{17/50}$ (W/kg) | Notes |
|---|---|---|---|---|---|---|---|
| 1 | — | 0.01 | 192 | 0.00 | 198 | 0.79 | Comparative Example |
| 2 | — | 0.01 | 190 | 0.00 | 198 | 0.79 | Comparative Example |
| 3 | 70 | 0.05 | 178 | 0.01 | 190 | 0.73 | Example |
| 4 | 70 | 0.06 | 166 | 0.01 | 192 | 0.72 | Example |
| 5 | 72 | 0.21 | 175 | 0.03 | 180 | 0.70 | Example |
| 6 | 80 | 0.22 | 99 | 0.04 | 168 | 0.69 | Example |
| 7 | 86 | 0.34 | 81 | 0.07 | 157 | 0.68 | Example |
| 8 | 88 | 0.59 | 21 | 0.08 | 151 | 0.67 | Example |
| 9 | 92 | 0.61 | 13 | 0.42 | 32 | 0.67 | Comparative Example |
| 10 | — | 0.00 | 200 | 0.00 | 200 | 0.80 | Comparative Example |
| 11 | 70 | 0.01 | 193 | 0.01 | 195 | 0.74 | Example |
| 12 | 70 | 0.05 | 178 | 0.01 | 185 | 0.73 | Example |
| 13 | 70 | 0.07 | 158 | 0.02 | 186 | 0.72 | Example |
| 14 | 76 | 0.38 | 62 | 0.04 | 162 | 0.71 | Example |
| 15 | 77 | 0.41 | 50 | 0.09 | 132 | 0.69 | Example |
| 16 | 77 | 0.53 | 33 | 0.17 | 75 | 0.69 | Example |
| 17 | 78 | 0.72 | 8 | 0.64 | 15 | 0.68 | Comparative Example |
| 18 | 77 | 0.41 | 48 | 0.03 | 158 | 0.75 | Example |
| 19 | 76 | 0.38 | 71 | 0.02 | 165 | 0.75 | Example |
| 20 | 82 | 0.35 | 46 | 0.02 | 162 | 0.72 | Example |
| 21 | 86 | 0.45 | 38 | 0.02 | 168 | 0.72 | Example |
| 22 | 77 | 0.18 | 68 | 0.03 | 153 | 0.73 | Example |
| 23 | 74 | 0.03 | 145 | 0.00 | 195 | 0.74 | Example |
| 24 | 92 | 0.32 | 45 | 0.25 | 55 | 0.74 | Comparative Example |
| 25 | 95 | 0.82 | 6 | 0.79 | 15 | 0.75 | Comparative Example |
| 26 | 74 | 0.35 | 58 | 0.04 | 162 | 0.67 | Example |
| 27 | 75 | 0.36 | 62 | 0.03 | 154 | 0.69 | Example |
| 28 | 78 | 0.34 | 63 | 0.02 | 148 | 0.70 | Example |
| 29 | 72 | 0.39 | 60 | 0.03 | 156 | 0.71 | Example |
| 30 | 71 | 0.35 | 55 | 0.02 | 148 | 0.72 | Example |
| 31 | 82 | 0.21 | 58 | 0.02 | 155 | 0.76 | Example |
| 32 | 83 | 0.32 | 62 | 0.02 | 152 | 0.78 | Example |
| 33 | 88 | 0.64 | 12 | 0.08 | 65 | 0.70 | Example |
| 34 | 87 | 0.45 | 29 | 0.05 | 143 | 0.71 | Example |
| 35 | 82 | 0.31 | 52 | 0.02 | 172 | 0.71 | Example |
| 36 | 71 | 0.02 | 182 | 0.01 | 195 | 0.80 | Comparative Example |
| 37 | — | 0.00 | 185 | 0.00 | 192 | 0.80 | Comparative Example |

Example 3

Cold-rolled sheets for grain-oriented electrical steel sheets, rolled to a final sheet thickness of 0.23 mm and containing Si: 3.3 mass %, Mn: 0.08 mass %, Cu: 0.05 mass %, Al: 0.002 mass %, S: 0.001 mass %, C: 0.06 mass %, and N: 0.002 mass % were decarburized. After primary recrystallization annealing, nitrogen treatment was applied by subjecting a portion of the cold-rolled sheets as a coil to batch salt bath treatment to increase the amount of N in the steel by 700 ppm. Subsequently, an annealing separator containing MgO as the primary component was applied, and final annealing including a secondary recrystallization process and a purification process was performed to yield grain-oriented electrical steel sheets with a forsterite film. The coating liquid A described above in Example 1 was then applied to the grain-oriented electrical steel sheets, and an insulating coating was formed by baking at 800° C. Subsequently, magnetic domain refining treatment was applied by dot-sequence irradiation or continuous irradiation, with an electron beam at a degree of vacuum in the working chamber of 1 Pa, on the insulating coating in a direction perpendicular to the rolling direction, and at 3 mm intervals in the rolling direction. As a result, material with a magnetic flux density $B_8$ of 1.92 T to 1.95 T was obtained.

For the material obtained in this way, the electron beam irradiation portion was first observed under an electron microscope to verify the properties of the irradiation mark region. Furthermore, in the same way as above, the interlaminar current and the withstand voltage were measured. Subsequently, as re-forming treatment, 1 g/m$^2$ of the coating liquid B in the above-described Example 1 was applied to both sides of the steel sheets, and the steel sheets were baked in a range at which the magnetic domain refinement effect is not impaired due to release of strain. The interlaminar current and the withstand voltage were then measured again. Furthermore, the 1.7 T, 50 Hz iron loss $W_{17/50}$ was measured in a single sheet tester (SST). Table 3 summarizes the measurement results.

Table 3 shows that for the nitriding treatment-subjected material outside our range, both the insulation properties and corrosion resistance before and after re-forming were worse than when not performing nitriding treatment. The nitriding treatment-subjected material within our range had equivalent insulation properties and corrosion resistance as when not performing nitriding treatment, demonstrating the usefulness of adopting our methods.

TABLE 3

| Condition | Nitriding treatment | Laser irradiation conditions: Irradiation pattern | Dot-sequence pitch (mm) | Acceleration voltage (kV) | Beam current (mA) | Scanning rate (m/s) | Beam diameter (mm) | Degree of damage to the coating Ratio of irradiation mark within irradiation region of beam (%) |
|---|---|---|---|---|---|---|---|---|
| 1 | yes | dot-sequence | 0.32 | 60 | 13 | 20 | 0.45 | 61 |
| 2 | no | | | | | | | 49 |
| 3 | yes | dot-sequence | 0.32 | 60 | 10 | 40 | 0.41 | 32 |
| 4 | No | | | | | | | 21 |
| 5 | yes | dot-sequence | 0.32 | 60 | 12 | 45 | 0.43 | 58 |
| 6 | no | | | | | | | 51 |
| 7 | yes | dot-sequence | 0.32 | 60 | 8 | 30 | 0.36 | 17 |
| 8 | no | | | | | | | 18 |
| 9 | yes | continuous | — | 60 | 10 | 25 | 0.36 | 75 |
| 10 | no | | | | | | | 62 |

| Condition | Degree of damage to the coating: Ratio of protrusion of 1.5 mm or more at edge of irradiation mark region (%) | Ratio of exposed portion of steel substrate in irradiation mark (%) | Insulation properties before re-forming: Inter-laminar current (A) | Withstand voltage (V) | Insulation properties after re-forming: Inter-laminar current (A) | Withstand voltage (V) | Iron loss $W_{17/50}$ (W/kg) | Notes |
|---|---|---|---|---|---|---|---|---|
| 1 | 75 | 85 | 0.78 | 5 | 0.68 | 7 | 0.67 | Comparative Example |
| 2 | 62 | 78 | 0.72 | 8 | 0.64 | 15 | 0.68 | Comparative Example |
| 3 | 18 | 95 | 0.37 | 32 | 0.32 | 35 | 0.72 | Comparative Example |
| 4 | 5 | 92 | 0.32 | 45 | 0.25 | 55 | 0.74 | Comparative Example |
| 5 | 78 | 96 | 0.95 | 5 | 0.85 | 5 | 0.73 | Comparative Example |
| 6 | 75 | 95 | 0.82 | 6 | 0.79 | 15 | 0.75 | Comparative Example |
| 7 | 1 | 80 | 0.17 | 75 | 0.02 | 161 | 0.71 | Example |
| 8 | 2 | 77 | 0.18 | 68 | 0.03 | 153 | 0.73 | Example |
| 9 | 35 | 85 | 0.56 | 18 | 0.04 | 148 | 0.69 | Example |
| 10 | 21 | 87 | 0.45 | 29 | 0.05 | 143 | 0.71 | Example |

The invention claimed is:

1. A grain-oriented electrical steel sheet, linear strain having been applied thereto by irradiation with a high-energy beam, the linear strain extending in a direction that intersects a rolling direction of the steel sheet, wherein an area ratio of an irradiation mark within an irradiation region of the high-energy beam is 2% or more and 20% or less, an area ratio of a protrusion with a height of 1.5 μm or more within a surrounding portion of the irradiation mark is 60% or less, and an area ratio of an exposed portion of steel substrate in the irradiation mark is 90% or less.

2. The grain-oriented electrical steel sheet according to claim 1, comprising an insulating coating formed after the irradiation with the high-energy beam.

3. The grain-oriented electrical steel sheet according to claim 1, wherein the direction in which the linear strain extends forms an angle of 30° or less with a direction orthogonal to the rolling direction of the steel sheet.

4. The grain-oriented electrical steel sheet according to claim 2, wherein the direction in which the linear strain extends forms an angle of 30° or less with a direction orthogonal to the rolling direction of the steel sheet.

5. A grain-oriented electrical steel sheet, linear strain having been applied thereto by irradiation with a high-energy beam, the linear strain extending in a direction that intersects a rolling direction of the steel sheet, wherein an area ratio of an irradiation mark within an irradiation region of the high-energy beam exceeds 20%, an area ratio of a protrusion with a height of 1.5 μm or more within a surrounding portion of the irradiation mark is 60% or less, an area ratio of an exposed portion of steel substrate in the irradiation mark is 30% or more and 90% or less, and an insulating coating is formed after the irradiation with the high-energy beam.

6. A method of manufacturing a grain-oriented electrical steel sheet comprising:

in manufacturing the grain-oriented electrical steel sheet according to claim 1 by applying, to a grain-oriented electrical steel sheet after final annealing, linear strain extending in a direction that intersects a rolling direction of the steel sheet, applying the linear strain by irradiating, with a continuous laser, a surface of the grain-oriented electrical steel sheet after final annealing.

7. The method according to claim 6, comprising:

subjecting a cold-rolled sheet for grain-oriented electrical steel to primary recrystallization annealing and then final annealing; and irradiating the grain-oriented electrical steel sheet after final annealing with the high-energy beam, wherein the cold-rolled sheet is subjected to nitriding treatment during or after the primary recrystallization annealing.

8. A method of manufacturing a grain-oriented electrical steel sheet comprising:

in manufacturing the grain-oriented electrical steel sheet according to claim 1 by applying, to a grain-oriented electrical steel sheet after final annealing, linear strain extending in a direction that intersects a rolling direction of the steel sheet, applying the linear strain by irradiating, with an electron beam, a surface of the grain-oriented electrical steel sheet after final annealing.

9. The method according to claim 8, comprising:

subjecting a cold-rolled sheet for grain-oriented electrical steel to primary recrystallization annealing and then final annealing; and irradiating the grain-oriented electrical steel sheet after final annealing with the high-energy beam, wherein the cold-rolled sheet is subjected to nitriding treatment during or after the primary recrystallization annealing.

10. A method of manufacturing a grain-oriented electrical steel sheet comprising:

in manufacturing the grain-oriented electrical steel sheet according to claim 5 by applying, to a grain-oriented electrical steel sheet after final annealing, linear strain extending in a direction that intersects a rolling direction of the steel sheet, applying the linear strain by irradiating, with a continuous laser, a surface of the grain-oriented electrical steel sheet after final annealing.

11. The method according to claim 10, comprising:

subjecting a cold-rolled sheet for grain-oriented electrical steel to primary recrystallization annealing and then final annealing; and irradiating the grain-oriented electrical steel sheet after final annealing with the high-energy beam, wherein the cold-rolled sheet is subjected to nitriding treatment during or after the primary recrystallization annealing.

12. A method of manufacturing a grain-oriented electrical steel sheet comprising:

in manufacturing the grain-oriented electrical steel sheet according to claim 5 by applying, to a grain-oriented electrical steel sheet after final annealing, linear strain extending in a direction that intersects a rolling direction of the steel sheet, applying the linear strain by irradiating, with an electron beam, a surface of the grain-oriented electrical steel sheet after final annealing.

13. The method according to claim 12, comprising:

subjecting a cold-rolled sheet for grain-oriented electrical steel to primary recrystallization annealing and then final annealing; and irradiating the grain-oriented electrical steel sheet after final annealing with the high-energy beam, wherein the cold-rolled sheet is subjected to nitriding treatment during or after the primary recrystallization annealing.

* * * * *